US005948126A

United States Patent [19]

Barratt et al.

[11] Patent Number: 5,948,126

[45] Date of Patent: Sep. 7, 1999

[54] GASOLINE COMPOSITION

[75] Inventors: David John Barratt, Thorton; Gautam Tavanappa Kalghatgi, Dodleston; Jian Lin, Upton-By-Chester, all of United Kingdom

[73] Assignee: Shell Oil Company, Houston, Tex.

[21] Appl. No.: 09/111,202

[22] Filed: Jul. 7, 1998

Related U.S. Application Data

[63] Continuation-in-part of application No. 08/767,897, Dec. 17, 1996.

[30] Foreign Application Priority Data

Mar. 15, 1996 [EP] European Pat. Off. ..... 96801782

[51] Int. Cl.[6] ..... C10L 1/18

[52] U.S. Cl. ..... 44/350; 44/352

[58] Field of Search ..... 44/30, 350, 351, 44/352

[56] References Cited

U.S. PATENT DOCUMENTS

| | | | |
|---|---|---|---|
| 2,241,760 | 5/1941 | Bean | 44/350 |
| 2,321,311 | 6/1943 | Mottlau | 44/350 |
| 2,599,338 | 3/1952 | Lefson | 44/350 |
| 2,841,480 | 7/1958 | Yust | 44/351 |
| 3,892,783 | 7/1975 | Duke | 260/346.1 |
| 4,191,536 | 3/1980 | Niebylski . | |
| 4,339,245 | 7/1982 | Burns . | |

FOREIGN PATENT DOCUMENTS

| | | |
|---|---|---|
| 174123 | 3/1986 | European Pat. Off. . |

*Primary Examiner*—Jacqueline V. Howard
*Assistant Examiner*—Cephia D. Toomer
*Attorney, Agent, or Firm*—Ohlandt, Greeley, Ruggiero & Perle

[57] ABSTRACT

The invention provides a gasoline composition which comprises a mixture of hydrocarbons of the gasoline boiling range containing an octane requirement reducing amount of an additive which comprises a furfuryl alcohol resin or derivative thereof and the use of the additive in a concentrate for a preparation of such gasoline composition and a method of operating a spark-ignition engine using such gasoline composition.

14 Claims, No Drawings

GASOLINE COMPOSITION

This is a continuation-in-part of application Ser. No. 08/767,897 filed Dec. 17, 1996, the entire disclosure of which is hereby incorporated by reference.

FIELD OF THE INVENTION

The present invention relates to a gasoline composition comprising a mixture of hydrocarbons of the gasoline boiling range containing an octane requirement reducing amount of an additive which comprises a particular furan derivative.

BACKGROUND OF THE INVENTION

The octane requirement increase (ORI) effect exhibited by internal combustion engines, e.g. spark ignition engines, is well known in the art. This effect may be described as the tendency for an initially new or clean engine to require higher octane quality fuel as operating time accumulates, and is coincidental with the formation of deposits in the region of the combustion chamber of the engine. Thus, during the initial operation of a new or clean engine, a gradual increase in octane requirement (OR), i.e. fuel octane number required for knock-free operation, is observed with an increasing build-up of combustion chamber deposits until a rather stable OR level is reached. This, in turn, seems to correspond to a point in time where the quantity of deposit accumulation on the combustion chamber and valve surfaces no longer increase but remains relatively constant. This so-called "equilibrium value" is usually reached between about 4,800 and 32,000 km. or corresponding hours of operation. The actual equilibrium value of this increase can vary with engine design and even with individual engines of the same design. However, in almost all cases the increase appears to be significant, with ORI values ranging from about 2 to 14 Research Octane Numbers (RON) being commonly observed in modern engines.

Various types of additives are known which may prevent or reduce deposit formation, or remove or modify deposits, in the combustion chamber and adjacent surfaces and hence decrease OR. These additives are generally known as octane requirement reduction (ORR) agents.

Object of the present invention is to provide a gasoline composition containing an additive selected from a particular class of furan derivatives which exhibit a surprisingly high octane requirement reduction activity.

SUMMARY OF THE INVENTION

The present invention provides a gasoline composition which comprises a mixture of hydrocarbons of the gasoline boiling range containing an octane requirement reducing amount of an additive comprising a furfuryl alcohol resin or derivatives thereof.

DETAILED DESCRIPTION OF THE INVENTION

In the context of the present invention, a furfuryl alcohol resin is defined as the polymer product obtained by polycondensation of optionally substituted furfuryl alcohol monomers (2-furanmethanol monomers). The furfuryl alcohol resin has a number average molecular weight in the range of from 150 to 5000, preferably in the range of from 150 to 500, as measured by gel permeation chromatography (GPC) using poly(styrene) calibration standards.

It will be understood that the furfuryl alcohol resin or derivative thereof, comprise in addition to the furyl group, a number of further furyl groups which are connected to the neighbouring furyl groups by means of an optionally substituted hydrocarbyl or alkoxycarbyl group.

Preferably, the furfuryl alcohol resin comprises the condensation product of non-substituted 2-furanmethanol monomers.

It will be understood that in the latter condensation product the additional furyl groups are connected to the neighbouring furyl groups by means of a methylene group.

The preparation of furfuryl alcohol resins is well known in the art. For instance, reference is made to Journal of Applied Polymer Science, Vol. 15, pp. 1079–1090 (1971), which document is hereby incorporated by reference.

Suitable monomers include those having the following general formula:

(I)

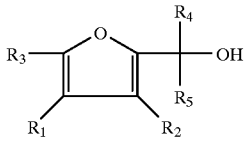

wherein $R_1$, $R_2$, $R_4$ and $R_5$ each independently represent hydrogen, a hydrocarbyl group, a nitrogen-containing, an oxygen-containing or a sulphur-containing hydrocarbyl group and $R_3$ represents hydrogen. The hydrocarbyl is selected from the group comprising an aryl, alkyl, alkenyl or cycloalkyl group. Suitably, the hydrocarbyl group comprises 2 to 50 carbon atoms, preferably 2 to 20 carbon atoms and more preferably 2 to 10 carbon atoms.

Suitable furfuryl alcohol resins or derivatives thereof include those obtained by polycondensation of different types of monomers (I).

In an embodiment of the invention, suitable furfuryl alcohol resins or derivatives thereof to be applied in accordance with the present invention include those having the following general formula (II) or (III):

(II)

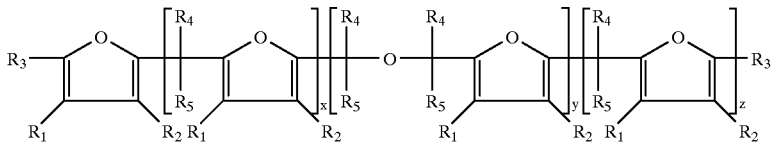

-continued (III)

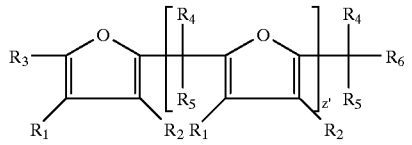

where $R_1$, $R_2$, $R_3$, $R_4$ and $R_5$ have the meaning as defined hereinabove with respect to formula (I); $R_6$ represents hydrogen, OH,

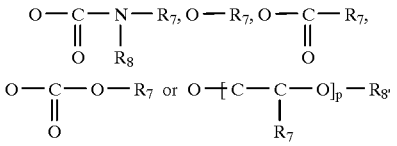

and $R_7$ and $R_8$ represent a nitrogen-containing, an oxygen-containing or a sulphur-containing hydrocarbyl group, wherein x is an integer ranging from 0 to 60, preferably from 0 to 30 and more preferably from 0 to 10; y is 0 or 1; z is an integer ranging from 0 to 60, preferably from 0 to 30 and more preferably from 0 to 10; z' is a integer ranging from 1 to 60, preferably from 1 to 30 and more perferably from 1 to 10; x+z ranges from 1 to 60, preferably 1 to 30 and more preferably from 1 to 10; and p is an integer ranging from 1 to 80, preferably ranging from 5 to 25.

It will be understood that the furfuryl alcohol resin or derivatives thereof will usually comprise a mixture of any of the polymer products of general formula II and III described above, and of course any unreacted 2-furan-methanol or derivative thereof.

The furfuryl alcohol resins of the present invention or derivatives thereof can suitably be further reacted with an alkenylsuccinic anhydride or derivative thereof.

The gasoline composition according to the invention usually comprises a major amount (more than 50% w) of a base fuel, suitable for use in spark-ignition engines, and a minor amount of the additive described above, suitably from 0.005 to 10% wt, preferably from 0.01 to 5% wt, with a range of 0.02 to 1% wt of the additive being more preferred, based on total gasoline composition.

The base fuel component includes mixtures of hydrocarbons boiling essentially in the gasoline boiling range from 30 to 230° C. These mixtures may comprise saturated, olefinic and aromatic hydrocarbons. They can be derived from straight-run gasoline, synthetically produced aromatic hydrocarbon mixtures, thermally or catalytically cracked hydrocarbon feedstocks, hydrocracked petroleum fractions or catalytically reformed hydrocarbons. The octane number of the base fuel is not critical and generally be above 65. In the gasoline, hydrocarbons can be replaced up to substantial amounts of alcohols, ethers, ketones (e.g. acetone) or esters. Naturally, the base fuels are suitably substantially free of water since water may impede a smooth combustion.

The gasoline composition according to the present invention may also contain other additives. It can, for instance, in addition contain a lead compound as anti-knock additive.

The gasoline composition according to the present invention includes therefore both leaded and unleaded gasoline. Preferably, the gasoline composition according to the present invention is an unleaded (ashless) gasoline.

The gasoline composition may also contain other additives such as antioxidants and/or a non-ionic surfactant, such as an alkylphenol or an alkyl alkoxylate. Suitable examples of such surfactants include C-$C_{18}$-alkylphenol and $C_2$–$C_6$-alkylethoxylate or $C_2$–$C_6$-alkylpropoxylate or mixtures thereof. The amount of the surfactant is advantageously from 10 to 1000 ppmw. The gasoline composition may still further contain other additives such as detergents (such as a polyolefin-substituted succinimide). Suitable examples of such detergents include ether polyolefin-substituted succinimides as described in EP-A-271937, which is hereby incorporated by reference. The amount of detergent is advantageously from 10 to 1000 ppmw.

The present invention also provides a concentrate suitable for addition to gasoline comprising a gasoline-compatible diluent (e.g. acetone or 2-butanol) with from 5 to 75% w, calculated on the diluent, of an additive comprising any of the furan derivatives as herein.

An additional advantage of the use of the furfuryl alcohol resin of the present invention or derivative thereof is that it promotes deposit flaking in combustion chambers bringing about considerable reductions in the Combustion Chamber Deposit weight.

The present invention further provides a method of operating a spark-ignition internal combustion engine which comprises introducing to said engine a gasoline composition in accordance with the present invention.

The present invention will now be illustrated by means of the following examples that are included for illustrative purposes only are not to be construed as limiting the invention.

EXAMPLE 1

10.6 g of a furfuryl alcohol resin of the present invention was obtained by distilling 100 g of QuaCorr 1300 (obtainable from QO Chemicals) under reduced pressure at a temperature from 42° C. (2.24 $10^{-3}$ atm) to 92° C. (6.58 $10^{-5}$ atm).

EXAMPLE 2

123 g of a furfuryl alcohol resin of the present invention was obtained by distilling 1,014 g of QuaCorr 1300 (obtainable from QO Chemicals) under reduced pressure at a temperature from 42° C. (7.24 $10^{-4}$ atm) to 120° C. (1.97 $10^{-3}$ atm).

EXAMPLE 3

150 g of a furfuryl alcohol resin of the present invention was prepared by mixing 500 g (5.1 mol) of furfuryl alcohol (obtainable from Aldrich) with 500 g of water and 1.15 g (11.5 mmol) of concentrated sulphuric acid and heating the mixture for 2 hours at a temperature of 50° C. The mixture so obtained, which separated into two phases, was then neutralised with a saturated sodium bicarbonate solution. The organic phase containing the furfuryl alcohol resin produced was extracted into ether, washed with water, dried with magnesium sulphate and evaporated under reduced pressure.

EXAMPLE 4

117 g of a furfuryl alcohol resin of the present invention was prepared in a manner similar as described in Example 3 except 400 g (4.1 mol) of the furfuryl alcohol was mixed with 400 g of water and 0.092 g (0.92 mmol) of concentrated sulphric acid and that the heating was carried out for 6 hours at a temperature of from 70° C. to 90° C.

EXAMPLE 5

255 g of a furfuryl alcohol resin of the present invention was prepared in a manner similar as described in Example 4 except that the heating was carried out for 24 hours at a temperature of 50° C., and that 0.92 g (9.2 mmol) of concentrated sulphuric acid was applied.

EXAMPLE 6

321 g of a furfuryl derivative of the present invention was prepared by reacting 150 g (0.42 mol) of the furfuryl alcohol resin prepared in Example 4 with 176 g (0.42 mol) of $C_{15}$–$C_{19}$ internal olefin-succinic anhydride (obtainable from Shell Chemicals) in toluene under refluxing for 6 hours, after which the toluene was evaporated.

EXAMPLE 7

This example illustrates the beneficial effect on octane requirement increase of gasoline additives comprising furfuryl alcohol resins in accordance with the present invention.

Each of the products obtained in Examples 1 to 6 and commercially available furfuryl alcohol resin QuaCorr 1300 were tested in a single cylinder Hydra engine; experiments 1 to 9. For reasons of comparison, tests were carried out with the engine using furan derivatives (Examples 8–10) falling outside the scope of the present invention; experiments 10 to 12. The following furan deviates were used in the respective experiments: 2-furaldehyde diethyl acetal (Example 8), 2-furaldehyde dimethylhydrazone (experiment 9) and furfuryl alcohol (Example 10). Deposits were built up at 1000 rpm with wide open throttle (WOT) and high load during 200 hours with an unleaded gasoline containing 0.5 wt % fluoranthene. A method was developed to detect the high rate of change in cylinder pressure during autoignition and Knock Limited Spark Advance (KLSA) was determined under 1000 rpm and WOT conditions. Calibration tests with reference fuels showed that the engine responded to the Research Octane Number (RON) of the fuel and that the KLSA changed by approximately one crank angle degree (cad) per octane number. Starting from clean combustion chamber conditions, the KLSA of the Hydra engine was reduced by between 8 and 10 cad over the first 200 hours operation as combustion chamber deposits built up, after which it reached equilibrium. Each additive was tested over a period of continued running, after which the engine was reconditioned on base fuel.

The various properties of the additives, conditions applied and results of experiments 1 to 12 are shown in Table 1. It will be clear from these results that the use of the present furfuryl alcohol resins or a derivative thereof (experiments 1–9) brings about a surprisingly high reduction in the octane requirement of the engine when compared with the additives just falling outside the scope of the present invention (experiments 10–12).

EXAMPLE 11

In two further experiments a VW engine (1.8 l) modified for research was operated at a speed of 1500 rpm. The deposits were built up at 2250 rpm and a load of 30 Nm. The engine is knock rated by measuring Knock Limited Spark Advance (KLSA) at 1500 rpm and a load of 80 Nm at frequent intervals during the test. Combustion chamber deposit (CCD) weight was monitored by stopping the engine and removing two plugs from the combustion chamber.

In experiment 13 the engine was run for 120 hours using an unleaded gasoline. The engine was then switched to the same gasoline which in addition contained 0.75 g/l of a furfuryl alcohol resin (QuaCorr 1300, ex QO Chemicals) which was dissolved in methylpropanol (0.5% by volume of the gasoline). An increase in KLSA was observed of 2.5 crank angle degrees, after 45 hours when a reference fuel of 85 octane number was used for knock rating. Over the same period of time the CCD weight was reduced from 41.5 mg to 26.6 mg. In other words use of the present additive package established a 36% reduction in CCD weight.

In experiment 14 the engine was run for 43 hours using an unleaded gasoline containing 0.5% by volume of methylpropanol. The engine was then switched to the same gasoline which in addition contained 0.35 g/l of QuaCorr 1300. An almost immediate increase was observed in KLSA of 3 crank angle degrees, whereas after 43 hours an increase was observed of 1.5 crank angle degrees. Over the same period of time the CCD weight was reduced from 29 mg to 24.5 mg. In other words the use of the present additive established a 16% reduction in CCD weight.

TABLE 1

| Product of Example | Experiment | Mn(GPC) | Mw/Mn | Dose g/l | DKLS A | time hrs |
|---|---|---|---|---|---|---|
| 1 | 1 | 175 | 1.0 | 0.3 | 1.3 | 24 |
| 2 | 2 | 156 | 1.1 | 0.3 | 1 | 1 |
| 3 | 3 | 228 | 1.2 | 4 | 1 | 1 |
| 4 | 4 | 272 | 1.5 | 4 | 1.2 | 1 |
| 4 | 5 | 272 | 1.5 | 0.3 | 0.8 | 1 |
| 5 | 6 | 388 | 1.5 | 4 | 0.7 | 1 |
| 6 | 7 | * | * | 0.6 | 1.1 | 1 |
| QuaCorr 1300 | 8 | 425 | 2.5 | 3 | 2.0 | 12 |
| QuaCorr 1300 | 9 | 425 | 2.5 | 0.3 | 1.6 | 1 |
| 8 | 10 | 170.21+ | * | 1 | 0 | 1 |
| 9 | 11 | 138.17+ | * | 1 | −1 | 1 |
| 10 | 12 | 98.10+ | * | 1 | 0.5 | 1 |

* not determined
\+ data from Aldrich

What is claimed is:

1. A gasoline composition which comprises a mixture of hydrocarbons of the gasoline boiling range containing an additive comprising a furfuryl alcohol resin obtained by polycondensation of optionally substituted furfuryl alcohol monomers or a derivative thereof said furfuryl alcohol resin having a number average molecular weight in the range from 150 to 5000 and comprising polymers having the formula:

(III)

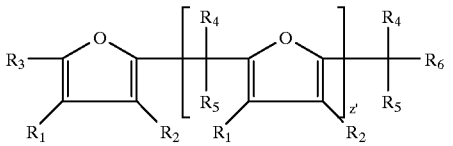

wherein, $R_1$, $R_2$, $R_4$, and $R_5$ each independently represent hydrogen, a hydrocarbyl group, a nitrogen-containing, oxygen-containing or sulphur-containing hydrocarbyl group, $R_3$ represents hydrogen, and $R_6$ represents hydrogen, OH,

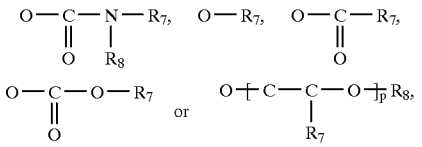

and $R_7$ and $R_8$ represent a nitrogen-containing, an oxygen-containing or a sulphur-containing hydrocarbyl group, wherein z' is an integer ranging from 1 to 60; and p is an integer ranging from 1 to 80.

2. The gasoline composition according to claim 1, wherein the furfuryl alcohol resin has a number average molecular weight in the range of 150 to 500.

3. A gasoline composition comprising a major amount of a base fuel and a minor amount of the additive defined in claim 1.

4. A gasoline composition comprising a major amount of a base fuel and a minor amount of the additive according to claim 2.

5. A gasoline concentrate comprising a gasoline-compatible diluent and from 5 to 75% w, calculated on the diluent, of an additive according to claim 1.

6. A method of operating a spark-ignition internal combustion engine which comprises introducing into said engine the gasoline composition of claim 1.

7. The gasoline composition of claim 1 wherein z' is an integer ranging from 1 to 30.

8. The gasoline composition of claim 1 wherein z' is an integer ranging from 1 to 10.

9. The gasoline composition of claim 6 wherein z' is an integer ranging from 1 to 30.

10. The gasoline composition of claim 6 wherein z' is an integer ranging from 1 to 10.

11. A gasoline concentrate comprising a gasoline-compatible diluent and from 5 to 75% w, calculated on the diluent, of an additive comprising a furfuryl alcohol resin obtained by polycondensation of optionally substituted furfuryl alcohol monomers or a derivative thereof comprising polymers having the formula:

(III)

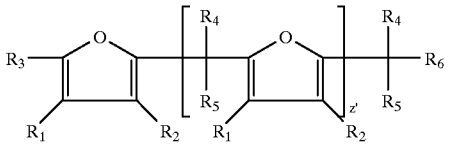

wherein, $R_1$, $R_2$, $R_4$, and $R_5$ each independently represent hydrogen, a hydrocarbyl group, a nitrogen-containing, oxygen-containing or sulphur-containing hydrocarbyl group, $R_3$ represents hydrogen, and $R_6$ represents hydrogen, OH,

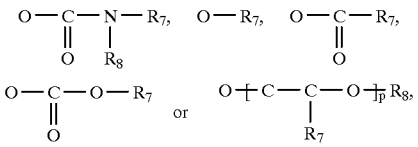

and $R_7$ and $R_8$ represent a nitrogen-containing, an oxygen-containing or a sulphur-containing hydrocarbyl group, wherein z' is an integer ranging from 1 to 60; and p is an integer ranging from 1 to 80.

12. The gasoline composition of claim 11 wherein z' is an integer ranging from 1 to 30.

13. The gasoline composition of claim 11 wherein z' is an integer ranging from 1 to 10.

14. A method of operating a spark-ignition internal combustion engine which comprises introducing to said engine the gasoline concentrate according to claim 11.

* * * * *